US007111754B1

(12) United States Patent
Siemens

(10) Patent No.: US 7,111,754 B1
(45) Date of Patent: Sep. 26, 2006

(54) COIN ROLL DISPENSER AND SYSTEM INCORPORATING SAME

(75) Inventor: John Siemens, Kleinberg (CA)

(73) Assignee: Namsys, Inc., Ontario (CA)

( * ) Notice: Subject to any disclaimer, the term of this patent is extended or adjusted under 35 U.S.C. 154(b) by 0 days.

(21) Appl. No.: 10/088,372

(22) PCT Filed: Sep. 13, 2000

(86) PCT No.: PCT/CA00/01046

§ 371 (c)(1),
(2), (4) Date: Mar. 12, 2002

(87) PCT Pub. No.: WO01/20563

PCT Pub. Date: Mar. 22, 2001

(30) Foreign Application Priority Data

Sep. 13, 1999 (CA) ..... 2282104

(51) Int. Cl.
*G07F 11/04* (2006.01)

(52) U.S. Cl. ..... 221/266; 221/200; 221/202

(58) Field of Classification Search ..... 221/266, 221/21, 67, 119, 156, 171, 200, 201, 202, 221/203, 277; 453/1, 2, 18, 63
See application file for complete search history.

(56) References Cited

U.S. PATENT DOCUMENTS 3,713,563 A * 1/1973 Dickensheets et al. ..... 221/205
4,063,633 A * 12/1977 Hall ..... 198/455
4,940,162 A * 7/1990 Thie ..... 221/129
4,966,304 A 10/1990 Kelly ..... 221/6
5,110,009 A 5/1992 Gartner et al. ..... 221/266
5,722,564 A 3/1998 Tiraboschi ..... 221/131
5,899,358 A * 5/1999 Daumueller ..... 221/196
5,938,072 A 8/1999 Lamoureux et al. ..... 221/253
6,092,977 A * 7/2000 Fuchigami ..... 414/746.4

FOREIGN PATENT DOCUMENTS

| | | |
|---|---|---|
| AU | 8985991 | 6/1992 |
| DE | 41 43 276 A1 | 7/1993 |
| WO | 99/09499 | 2/1999 |

* cited by examiner

*Primary Examiner*—Donald P. Walsh
*Assistant Examiner*—Mark J. Beauchaine
(74) *Attorney, Agent, or Firm*—Vidas, Arrett & Steinkraus

(57) ABSTRACT

An apparatus for use in dispensing coin rolls is disclosed. The apparatus includes a receptacle, to hold the coin rolls in a vertically stacked array, a dispensed, to dispense the coin rolls from a bottom of the receptacle, and a controller, to control the dispensing means responsive to instructions from a user. The apparatus may be used to construct a change making machine, and a plurality of change making machines may be used to form a broad cash and coin dispensing system that is centrally controlled.

23 Claims, 9 Drawing Sheets

COIN ROLL DISPENSER AND SYSTEM INCORPORATING SAME

This application is a national stage entry of PCT/CA00/01046 filed Sep. 13, 2000 which claims priority from Canadian Patent Application number 2,282,104 filed Sep. 13, 1999.

FIELD OF THE INVENTION

This invention relates to the general field of currency-handling equipment, and more particularly to devices capable of dispensing rolled coins in response to user demand.

BACKGROUND OF THE INVENTION

The use of currency in the form of paper bills and metal coins remains a fixture of the modem commercial world. While a large portion of commercial transactions make use of non-currency financial instruments such as credit cards, debit cards, checks and the like, the continued extensive use of currency seems assured. The favourable characteristics of currency include convenience, especially for smaller transactions, and anonymity of purchase.

The wide use of metal coins however presents problems for bulk users of coins, such as retail merchants, and also for the suppliers of bulk coins, primarily banks.

For customer convenience, retail merchants generally prefer to maintain an adequate supply of coins at least most of the time. However, the type of currency offered at any given time by their customers is unpredictable and inconsistent. In many cases a series of customers will offer only paper currency, in which case the merchant's coin reserves may be quickly depleted. This can inconvenience subsequent customers. Many merchants would then find it desirable to replenish their coin reserves, and would do so if it could be done quickly, accurately, and conveniently.

At present, the primary source of bulk coins are local bank branches, staffed by tellers. Therefore it becomes necessary to travel to the branch, wait in line, and be served by bank staff. Banks of course are usually only open during regular business hours, whereas many merchants are open evenings and even overnight. Such merchants often have no recourse but to wait until the next day.

Besides merchants, there are always individuals and other organizations that at various times have a need for bulk coins. They too generally have to go to the bank and wait in line. Another example where coins are in high demand are casinos, particularly the slot machines which use a token type metallic coin, generally valued at one dollar. The high volume nature of the slot machines often means that there is a steady stream of customers seeking to purchase tokens in bulk.

For banks, casinos, and other suppliers, providing bulk coins can present complicated management problems that are usually costly and unrewarding. To begin with, the coins themselves are heavy and bulky. Storage and transportation of the coins is therefore complex and costly. As noted, live staff are invariably needed to effect the transaction. This again is costly, and is particularly noteworthy in contrast to the comparative ease and low cost manner by which paper currency is routinely dispensed through automatic teller (ATM) machines. Additionally, due to the commodity-like nature of the matter, the profit margins that can be charged for bulk coin transactions are generally fairly low compared to other financial services. In many cases there is no additional charge as the service is included in the client's regular fees. So the result is that the supplying of bulk coins is generally a problematic business proposition —having cumbersome management issues, high costs, and low returns.

Most of the solutions offered to improve upon this situation involve attempts to build some sort of automatic dispensing machine for coins, similar to the ATM's commonly used to dispense paper currency. It should be noted that for convenience bulk coins are invariably provided in rolls, wrapped in paper or plastic. Thus the dispensing machines typically store a given capacity of coin rolls of different denominations, and attempt to dispense a given selection of coin rolls as required by the customer. This arrangement, if it works, would succeed in removing the need for a permanent staff person to handle every transaction.

In practice there have been problems with the automatic coin dispenser machines provided so far. While the need for a transaction clerk may be removed, there is always a need for regular service to replenish the coin reserves. To minimize this cost a high coin reserve capacity is important. However, most of the machines available to this point have not been constructed to have a high capacity, and have therefore incurred relatively large costs in this regard.

Another problem with the machines available so far is that they usually rely on some sort of mechanical system to grasp and eject each coin roll. These systems are especially prone to jamming and breakdown. This is not surprising, as individual coin rolls are an especially bulky and heavy item to manage, and accordingly present special problems. When there is a breakdown, there is of course the need to send a service person, which adds to costs. Further, until the machine is serviced the unit is not operational.

For example, one machine uses a series of stacked trays to hold the coins. Each tray can only hold only one single-file layer of coin rolls. Accordingly, it takes several stacks of such trays, arranged side-by-side, and a correspondingly large machine, to attain any sort of meaningful overall capacity. There is a solenoid-based dispense mechanism that moves between trays, both vertically and horizontally, to dispense Individual coin rolls as instructed from each denomination. The actual ejection method consists of the solenoid based plunger mechanically pushing the first coin roll in line in the particular tray. Since this system has a mechanical part that positions the dispense mechanism, and another part that ejects a specific coin roll, it is excessively complicated and therefore prone to jamming and breakdown. Another problem is that the machines are slow, being able to dispense only one coin roll from one denomination at a time. Yet another problem is that these machines cannot handle plastic shrink-wrapped coin, since plastic-wrapped coin rolls tend to flex excessively. Accordingly, when contacted by the solenoid based plunger, plastic coin rolls may flex rather than be ejected. Another problem is that the user interfaces of the machines are hard-to-use and complicated, unlike, for example, ATM machines. Additionally, there may be poor integration with the overall financial system of which the machines are a part.

In the absence of any meaningful solution to the problems posed by the automatic coin dispensing machines produced so far, using and providing bulk coins may continue to be a costly and inconvenient proposition.

SUMMARY OF THE INVENTION

What is required is an automated coin roll dispenser which overcomes the problems associated with the prior art devices. Most particularly, this dispenser should have as high capacity as possible for a given volume, so that service calls to replenish the device would be minimized. It should employ a method of organizing and dispensing coin rolls that is as simple and workable as possible, to minimize any instances of jamming or breakdown. It would also be advantageous if it contained a self-correcting mechanism that could fix a breakdown in those instances when it does occur. In addition, the device should have an easy-to-use user interface that is preferably similar in simplicity and flexibility to use as ATM machines. It should be able to accommodate a wide variety of coins, preferably every denomination in circulation in the region. It would also be advantageous if it could handle any kind of wrapping material, including plastic wrapped coin rolls. The coin roll dispenser should be able to be used as the key component of a change making machine, which would have an easy-to-use user interface, and the ability to dispense different denominations of coin rolls simultaneously rather than just sequentially. Such a machine should be able to provide coin roll change in exchange for paper currency, or through authorization provided by an ATM or other magnetic card. Finally, it would be advantageous for the change making machines to themselves be able to communicate with a central authority, so that they could be integrated with an overall cash management system that maintains precise information regarding coin reserves over any desired area.

Accordingly, there is provided an apparatus for use in dispensing coin rolls according to the present invention comprising:

- a receptacle, to hold the coin rolls in a vertically stacked array;
- a dispensing means, to dispense the coin rolls from a bottom of the receptacle; and
- a controller, to control the dispensing means responsive to instructions from a user;
- wherein, upon receiving instructions from a user to dispense coin rolls, said controller controls said dispensing means so that said coin rolls are dispensed from the receptacle.

BRIEF DESCRIPTION OF THE DRAWINGS

Reference will now be made, by way of example only, to preferred embodiments of the invention as illustrated in the attached figures.

DETAILED DESCRIPTION OF THE PREFERRED EMBODIMENTS

Figure 1:
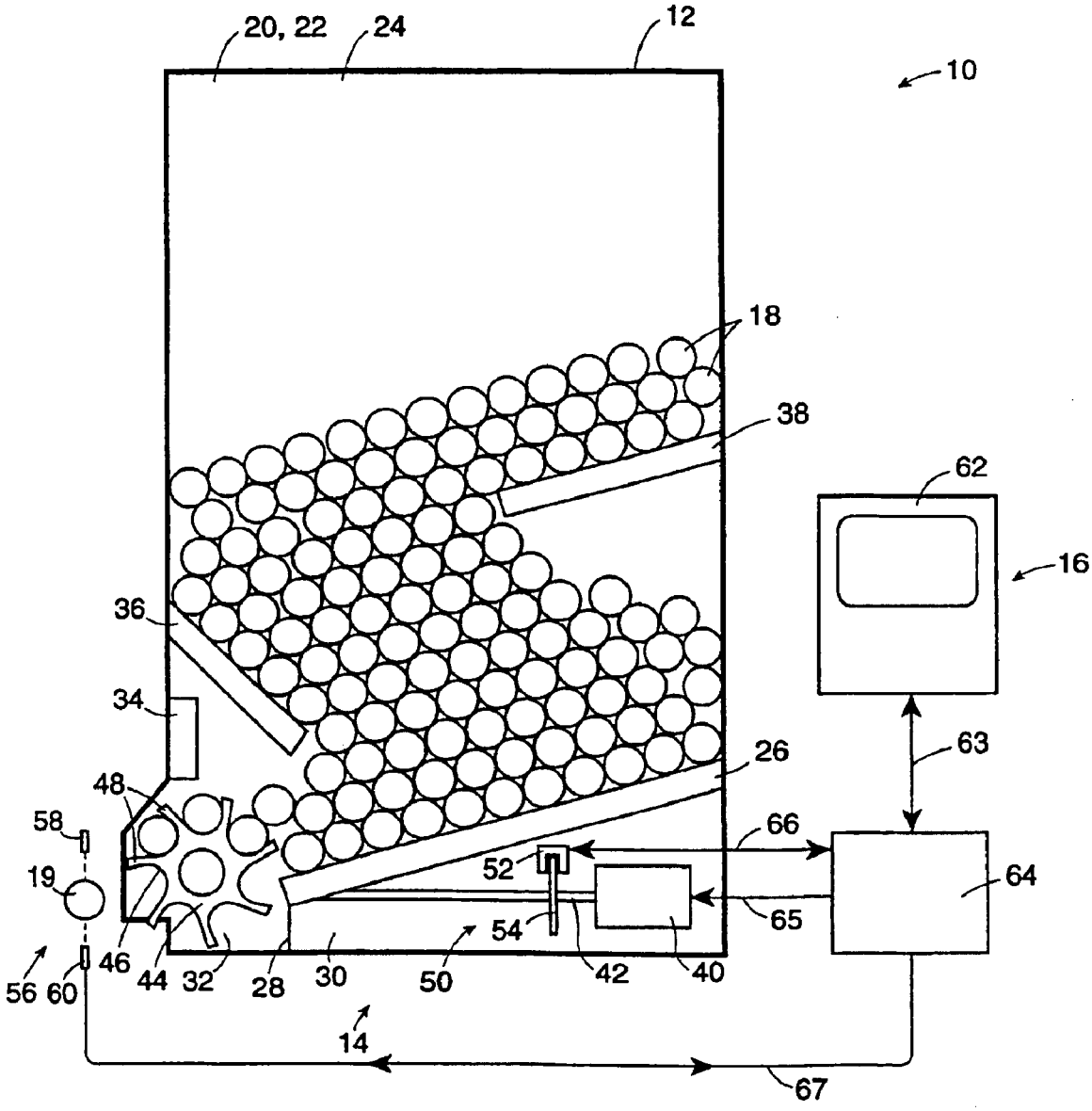
FIG. 1 is a schematic view of the apparatus of the present invention, including a processor and an electrical interface.

FIG. 1 shows a schematic view of an apparatus comprising the coin roll dispenser according to the present invention. The apparatus is generally indicated with reference numeral 10, and comprises a receptacle 12, a dispensing means generally indicated by reference numeral 14, and a controller generally indicated by reference numeral 16. The receptacle 12 generally houses a plurality of coin rolls 18. As will be discussed in greater detail, the apparatus 10 functions to sequentially dispense coin rolls 18, one-at-a-time, from the receptacle 12. In FIG. 1, coin roll 19 represents a coin roll in a position after it has been dispensed from the receptacle 12.

Figure 2:
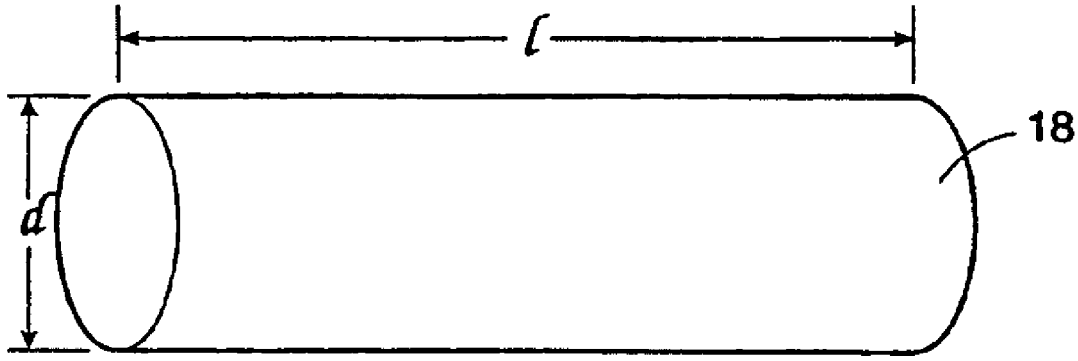
FIG. 2 is a perspective view of a coin roll.

The coin rolls 18 should be familiar to a person skilled in the art as referring to a group of coins all of the same denomination that are wrapped in a close fitting enclosure such as paper or plastic for convenient handling. The number of coins in a coin roll of a particular denomination are always the same. As a result, as shown in FIG. 2, which is a perspective view of a single coin roll, all of the coin rolls of a particular denomination will have a common cylindrical shape. Further, the coin roll will have a length l and a diameter d corresponding to the particular dimensions and roll size of the denomination.

The apparatus 10 of the present invention has been configured to accommodate coin rolls corresponding to all of the common coins of the United States and Canada. These include the one cent piece, or penny, the five cent piece or nickel, the ten cent piece or dime, and the twenty-five cent piece or quarter. Other types of coin for which the present invention has been configured include the U.S. 50 cent piece, the Canadian one-dollar and two-dollar coin, and also coin rolls comprised of tokens used in casino slot machines. As will be shown, it is an advantage of the present invention that it can be readily adapted to accommodate a wide variety of coin rolls, corresponding to coins with widely varying dimensions. It can therefore also be appreciated that the apparatus of the present invention can be adapted for use with other coins not mentioned, such as coins used as currency in other countries outside of the U.S. and Canada, or tokens such as those used in transit systems or vending machines.

Returning to FIG. 1, it can be seen that the receptacle 12 is generally a hollow container or canister oriented vertically so that the enclosed coin rolls 18 can be stacked on top of each other to form a vertically stacked array. The receptacle may be conveniently constructed from painted sheet metal, but it can be appreciated that other materials may also be used.

The receptacle has a back wall 20 and a front wall 22, which are indicated in FIG. 1 but not shown in perspective because of the schematic nature of the view. The back wall 20 is simply the fixed back portion of the receptacle 12. The front wall 20 is preferably hinged to form a door that may be opened to permit access to the interior of the receptacle 12. Also indicated in FIG. 1 and not shown in perspective is a back plate 24 that may be attached to the back wall 20. The distance between the respective interior surfaces of the front wall 22 and the back wall 20, or between that of the front wall 22 and the back plate 24, if present, define an interior thickness that closely accommodates the length of the individual coin roll 18 housed in the receptacle 12. This close accommodation is achieved by sizing the interior thickness to be only fractionally longer than the length l of the coin rolls 18. As a result, when the coin rolls 18 are deposited into the receptacle 12 so that they are oriented perpendicular to the back wall 20 and front wall 22, they are unlikely to have sufficient room to turn so as to become parallel to the back wall 20. In this way, the interior thickness of the receptacle 12 is sized and shaped to closely accommodate the length l of the coin rolls 18, so that they can be maintained in an orientation that is approximately perpendicular to the back wall 20.

The hollow interior of the receptacle 12 may now be further described. There is a lower ramp 26, which projects from one side of the receptacle 12 and extends on a downward slope to a vertical end plate 28. The vertical end plate 28 extends from the bottom of the receptacle 12 to the bottom of the lower ramp 26. The lower ramp 26 and end plate 28 define an enclosed space 30 that is isolated from the rest of the hollow interior of the receptacle 12, and that occupies a bottom portion of the receptacle 12. As shown in FIG. 1, the remaining bottom portion of the receptacle defines a wheel space 32 that is not enclosed, and that in the particular configuration of FIG. 1 causes the receptacle 12 to flare out slightly.

A jam plate 34 is located above the wheel space 32, projecting from a side wall of the receptacle 12. The jam plate is a metal plate that, for the particular configuration of FIG. 1, extends about ¼ to ½ inch from the side wall, is approximately 3 inches high, and has a width up to about the interior thickness of the receptacle 12.

The remainder of the hollow interior of the receptacle 12, constituting the broad upper portion, is largely empty except for the presence of a guide means, which in the preferred embodiment shown constitute one or more guide ramps. There is a first ramp 36 located above the wheel space 32 and jam plate 34. Like the lower ramp 26, the first ramp 36 projects from a side wall and extends along a downward slope. Unlike the lower ramp 26, the first ramp 36 is not supported at Us end by a vertical end plate, and therefore the first ramp 36 does not define an enclosed space. There is also shown a second ramp 38 that extends from the opposite side wall, positioned above the lower ramp 26. The second ramp 38 is otherwise similar to first ramp 36 in that it extends for a fixed length along a downward slope, and is not supported by a vertical end plate. Not shown in FIG. 1 is that there may also be a third ramp and possibly further ramps. Such ramps would be similar in construction to the first and second ramps shown, and would likely also be successively higher and project from successive alternating sides of the receptacle 12.

As can be seen from FIG. 1 the various ramps in the receptacle 12 form surfaces that support the coin rolls 18 and assist in guiding the coin rolls 18 towards the bottom of the receptacle 12. Accordingly, ft is preferred that the ramps be constructed from a strong material, and it has been found that ramps formed from 16 gauge steel are adequate. Further, it is preferred that stainless steel be used, as non-stainless steel would need to be painted to prevent rust. Painted steel would have a tendency to flake off over time, and might also rub onto the wrapper material of the coin rolls.

It can be appreciated from FIG. 1 that the bulk of the interior space of the receptacle 12 is available to store the coin rolls 18. Accordingly, it is an advantage of the present invention that it is able to store a large capacity of coin rolls for a given size of receptacle. For example, a receptacle sized at about 36 inches high and 22 inches wide was found to have a capacity of about 1066 rolls of pennies, 930 rolls of nickels, 1200 rolls of dimes, and 725 rolls of quarters.

The dispensing means, shown generally as 14 in FIG. 1, may now be further described. In the preferred embodiment the dispensing means 14 comprises an electric motor 40 which drives a shaft 42. These elements are located in the enclosed space 30. The electric motor 40 may be a common gear reduction motor, and is preferably a reversible motor. The shaft 42 extends through a hole in the vertical end plate 28 and, through a worm drive, not shown, connects to a toothed wheel 44, located in the wheel space 32. The toothed wheel 44 contains a plurality of slots 46 that are defined by adjacent teeth 48 of the wheel. It may be noted from FIG. 1 that the slots 46 are sized and shaped to hold one coin roll 18, but cannot hold two coin rolls. Further, it may be noted that the teeth 48 of the wheel have an outer edge or lip that is configured to receive coin rolls 18 positioned at the edge of the lower ramp 26, or in said region. The toothed wheel 44 may be constructed of any durable material, and it has been found that making the toothed wheel 44 out of cast aluminium provides adequate results.

The dispensing means 14 also includes a jam detector 50, which comprises an opto-coupler 52 and optical disk 54. The optical disk 54 is a small disk mounted through its axis onto the shaft 42 of the electric motor 40. The optical disk 54 is solid, except for a series of small holes located along its outer periphery. The opto-coupler 52 is a common sensing device. It has two broad arms that form a shape like the letter "U". The opto-coupler 52 is mounted so that the outer periphery of the optical disk 54 fits between the arms of the opto-coupler 52.

The dispensing means 14 also includes a dispense detector 56, located outside the receptacle 12. The dispense detector 56 comprises a conventional infrared light emitting diode (l.e.d.) 58 and a photo-sensor 60.

The controller, shown generally as 16 in FIG. 1, may now be further described. In the preferred embodiment the controller 16 comprises a processor 62 and an electrical interface 64. The processor 62 may be any type of computer having a visual display screen, and is most commonly a personal computer. Further, in the coin roll dispense application of the present invention it has been found to be convenient to use a touchscreen computer, where the user interacts with the computer by touching a screen rather than using a keyboard, and where the computer electronics are housed behind the screen. There is a software control program running on the processor 62 that generally operates an interface with the user, and also communicates with the electrical interface 64. The electrical interface 64 generally comprises a microcontroller, not shown, with an embedded software program in on-board memory, and associated support electronics. The embedded program maintains communication with the processor 62, and also with the electric motor 40, jam detector 50, and dispense detector 56.

The communication lines maintained by the controller 16 are shown in FIG. 1. There is a two-way connection 63 between the electrical interface 64 and the processor 62. The electrical interface 64 communicates with the electrical motor 40 over line 65, and maintains two-way connections with the jam detector 50 over line 66, and with the dispense detector over line 67. The lines connecting the various components are all standard electrical connections that would be well known to those skilled in the art.

The operation of the coin roll dispenser of the present invention may now be described. A user interacts with the processor 62 to provide instructions as to the number of coin rolls desired. The processor 62 communicates said instructions to the electrical interface 64. Through the embedded software program, the electrical interface 64 signals electric motor 40 to operate. As electric motor 40 engages, it turns shaft 42, which in turn, through the worm drive not shown, turns the toothed wheel 44. As toothed wheel 44 turns individual coin rolls 18 adjacent to the toothed wheel 44 slide into the open slots 46. This process is aided by the curl designed into the outer edge of the teeth 48, which acts to help scoop up adjacent coin rolls.

As the toothed wheel 44 completes its rotation, the individual coin rolls 18 fall out through a hole in the receptacle 12, where, as shown by coin roll 19, they become available for collection by the user.

When the user instructions are received, besides turning on the electric motor 40 the electrical interface 64 also turns on the light emitting diode (l.e.d.) 58 that is part of the dispense detector 56. In the ordinary case, when there is no coin roll dispensed, the light from the l.e.d. enters the photo sensor 60, completing a circuit. However when a coin roll is dispensed, as represented by coin roll 19 in the drawing, the coin roll crosses the light path, breaking the circuit. Through communication with the dispense detector 56 on line 67, electrical interface 64 receives a signal every time a coin roll 18 is dispensed. In this way, the embedded program in electrical interface 64 receives the information it needs to keep count of the number of coin rolls 18 actually dispensed. When the number dispensed matches the number requested by the user, the electrical interface 64 signals the electric motor 40 to stop, and informs the processor 62 that the task is completed.

The electrical interface 64 also monitors whether there is a jam in the system through its connection on line 66 with jam detector 50. Opto-coupler 52 emits light from one arm, and detects the light in the other arm. When there is nothing between the arms, there is a closed circuit. However, the optical disk 54 is positioned between the arms. The optical disk 54 rotates with the shaft 42, and is positioned so that the holes on its periphery are in the path of the light emitted by the opto-coupler. Therefore as the optical disk 54 turns, the light is alternately passed and blocked, producing a pulse output from the opto-coupler 52. While the motor turns, the system is not jammed, and there is a pulsed signal. However, if a jam develops the shaft will stop rotating and the output from the opto-coupler 52 will settle at a uniform high or low. This will inform the electrical interface 64 that there is a jam in the system.

The jam detector 50 refers to any system that detects a problem with the dispensing means 14, not just where there is a jam of coin rolls that stops the shaft 42 from any rotation. For example, there could be a jam that would slow down the motor, or cause it to rotate the shaft erratically, rather than cease all rotation. Another possible problem is where the shaft stops rotating because of a motor malfunction rather than from any jam caused by the coin rolls. The jam detector 50 of the present invention, including the embodiment shown involving an opto-coupler and optical disk, would through its signal connection with the electrical interface 64 inform the electrical interface 64 of the problem.

The embedded program in the microcontroller of electrical interface 64 includes a re-activation procedure to employ when it receives a signal from the jam detector 50 that there is any problem with the dispensing means. It was noted that the electrical motor should be a reversible motor. This type of motor would have a forward mode, In which the motor shaft is turned in one direction, and a reverse mode in which the motor shaft 42 turns in the reverse direction. In the ordinary course, the motor shaft 42 turns in the forward direction, and this causes the toothed wheel 44 to rotate so that it picks up coin rolls and causes the coin rolls to be dispensed. The re-activation procedure consists of signalling the motor to run in reverse for a predetermined time, and then attempting to run the motor in forward mode. If there is a jam caused by the coin rolls, turning the toothed wheel in the reverse direction may succeed in unblocking the jam. The re-activation procedure will repeat this procedure up to a pre-determined number of times if it is unsuccessful, at which point it will stop, and inform the processor 62 that the receptacle is not available.

Initially, the receptacle 12 is filled with coin rolls 18 so that there are coin rolls 18 filling the entire hollow interior, up to the top, except for the enclosed space 30. As the coin rolls are dispensed one-by-one, over time the remaining coin rolls move as a mass under the Influence of gravity towards the bottom of the receptacle 12. As shown, this can open up space at the top of the receptacle, and also under the first ramp 36 and second ramp 38, which spaces were all previously full of coin rolls when the receptacle was initially stocked. The coin rolls are further directed towards the bottom of the receptacle by the various ramps. At the very bottom, the lower ramp feeds coin rolls directly to the toothed wheel 44. In this way, the receptacle 12 of the present invention is configured so that all of the coin rolls 18 should proceed to the toothed wheel 44, where they can be picked up and dispensed.

It can now be appreciated that the coin roll dispenser of the present invention provides a convenient and productive means for a bulk coin roll supplier to provide coin rolls to its customers. The use of a processor 62 and a software control program to handle the user interface eliminates the need and expense for a live clerk. The relatively simple receptacle in which gravity and passive guide ramps guide the coin rolls to the dispensing means, and where the receptacle is sized and shaped to accommodate a particular coin roll, minimizes jamming or blockages that could occur. When and if a jam does occur, it is an advantage of the present system that it also includes a re-activation procedure that may succeed to remove the jam and re-start the system. It is also an advantage of the present invention that the dispensing means is relatively simple and that it is fixed in one place, dedicated to a single receptacle. This avoids the problems associated with using a single dispense mechanism for more than one receptacle, which requires a complicated mechanism to move the dispensing means from one receptacle to another. Yet another advantage of the present invention is that it can dispense coin rolls wrapped in plastic, as well those wrapped in paper.

As noted, it is yet another advantage of the present invention that it can be configured to handle a wide variety of coin rolls, while minimizing the risk of jamming. This is achieved by modifying some of the parameters of the apparatus to account for the different dimensions of different coin rolls.

Figure 3:
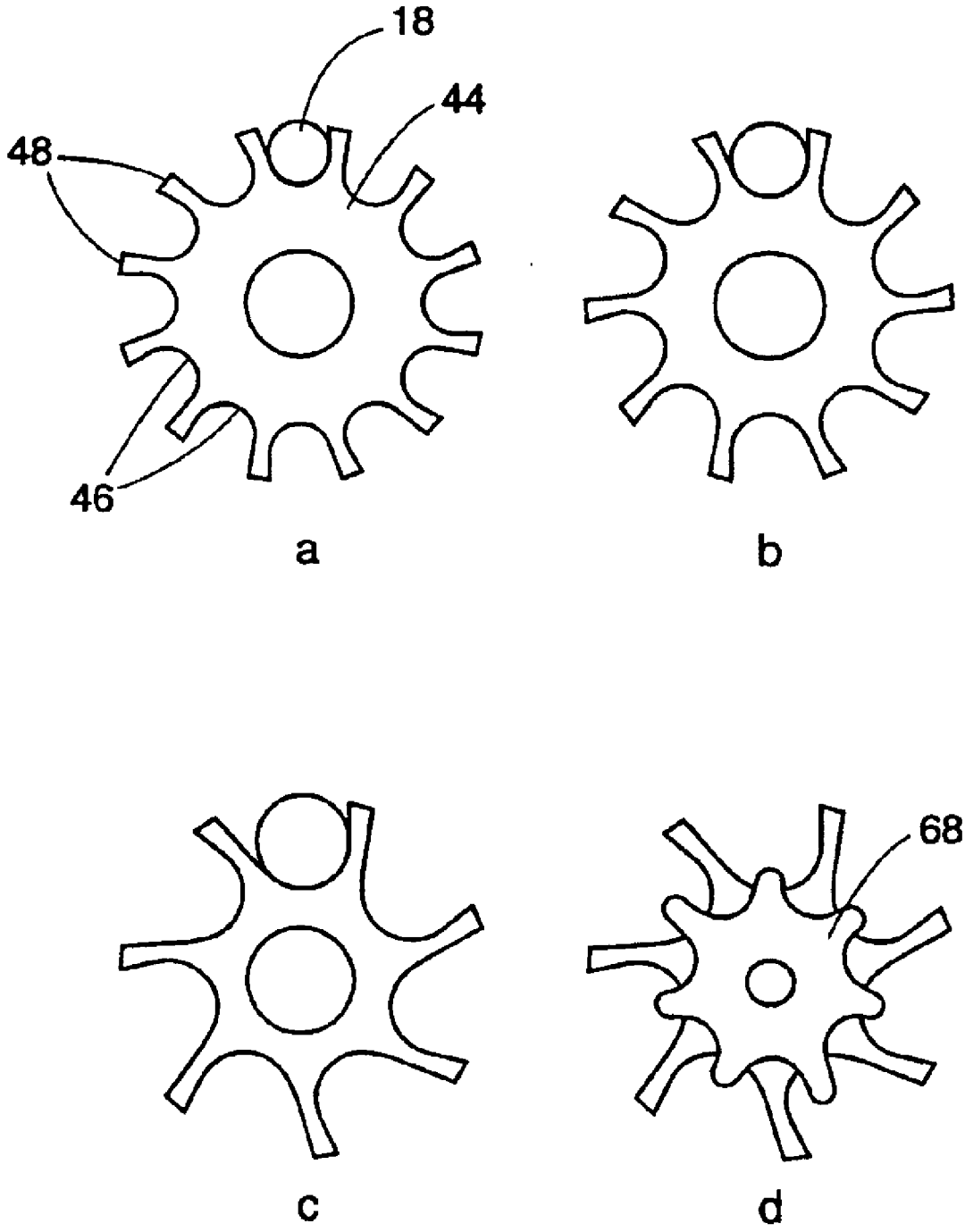
FIGS. 3(*a*) to (*d*) are side views of different types of toothed wheels.

One of the elements of the invention that is adaptable for different coin rolls is the toothed wheel 44. FIGS. 3(*a*) to (*c*) show a sample of three toothed wheels, used with different coin rolls. FIG. 3(*a*) has 12 teeth and slots, and is representative of the toothed wheels that are used with small diameter coins such as pennies, nickels, or dimes (though the toothed wheels for each of these three coins would have differently shaped teeth and slots). FIG. 3(*b*) has 10 slots and is used with quarters. FIG. 3(*c*) has 7 slots, and is used with casino tokens. FIG. 3(*d*) is the same casino token toothed wheel as is used with FIG. 3(*c*), with the addition of a cam wheel 68 that will be discussed below.

As noted, the slots for any given coin roll are sized and shaped to accommodate one coin roll, and to be too small to hold two coin rolls. In this way, the risk of the dispensing means dispensing two coin rolls at a time is reduced. Also, the outer edge of the teeth in each toothed wheel is shaped to have a curl to assist in picking up adjacent coin rolls.

Figure 4:
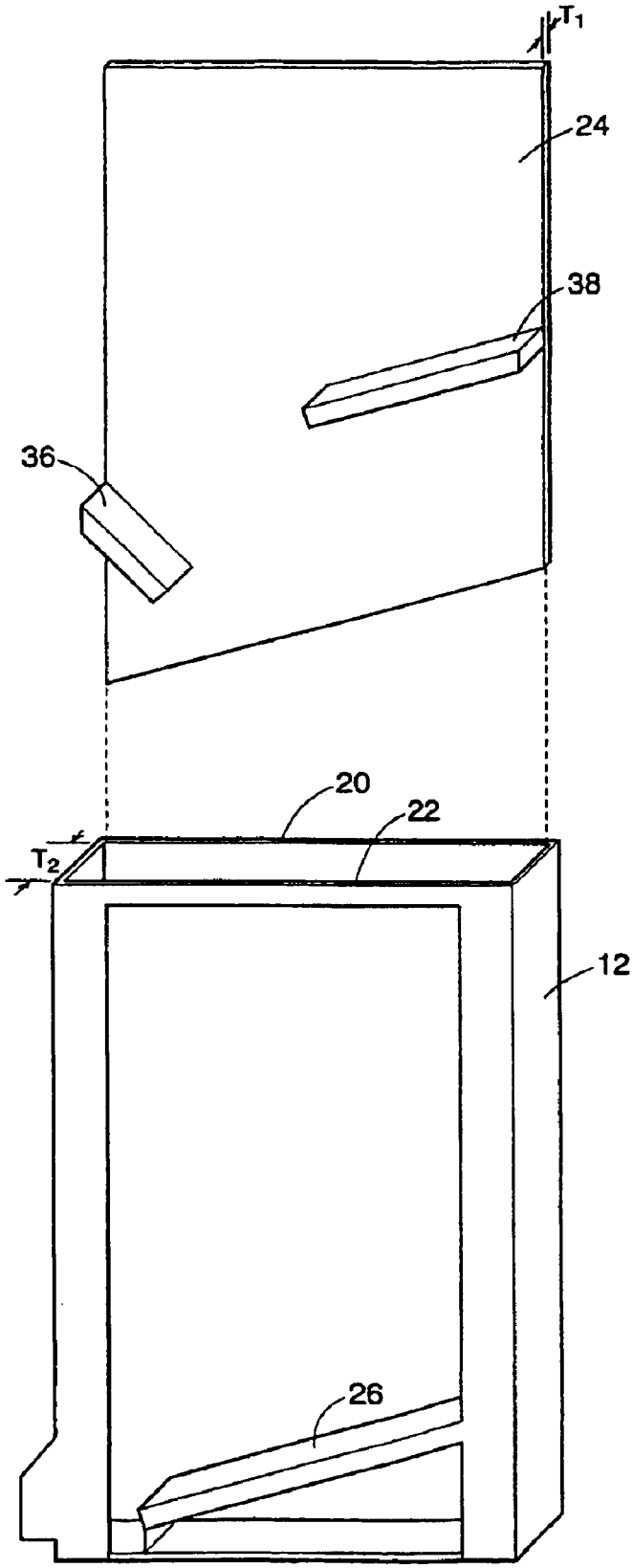
FIG. 4 is a perspective view of a receptacle and corresponding backplane.

FIG. 4 illustrates how the interior thickness of the receptacle 12 is adapted to accommodate different coin rolls. The receptacle 12 is shown having a thickness T2, being the distance from the back wall 20 to the front wall 22. The receptacle 12 is sized so that this thickness T2 closely accommodates the longest coin rolls expected to be used. In the case of the group of coins used with the preferred embodiment, the longst coin rolls are those of pennies or nickels, which have the same length. The thickness T2 that accommodates penny or nickel coin rolls is about 3½ inches. For any other coin roll, which is shorter than that of pennies and nickels, the back plate 24 having a thickness T1 is inserted to reduce the Interior thickness, so that the resulting interior thickness closely accommodates the coin roll to be dispensed.

FIG. 4 also shows how back plate 24 is installed. Back plate 24 is inserted down through the top of the receptacle 12, and is then attached to the back wall 20. The preferred method of attachment is screws, though of course other means could also be used.

The use of back plate 24 can be demonstrated by example. The back plate for quarters is approximately ⅝ inches. Therefore when installed, the interior thickness of the receptacle is approximately 3½ inches less ⅝ inches, or about 2⅞ inches. Another example is the U.S. 50 cent piece, which has a relatively short coin roll that requires a back plate 1⅝ inches thick. Accordingly, the interior thickness of the receptacle for the U.S. 50 cent piece dispenser is about 3½ inches less 1⅝ inches, or 1⅞ inches.

Figure 5:
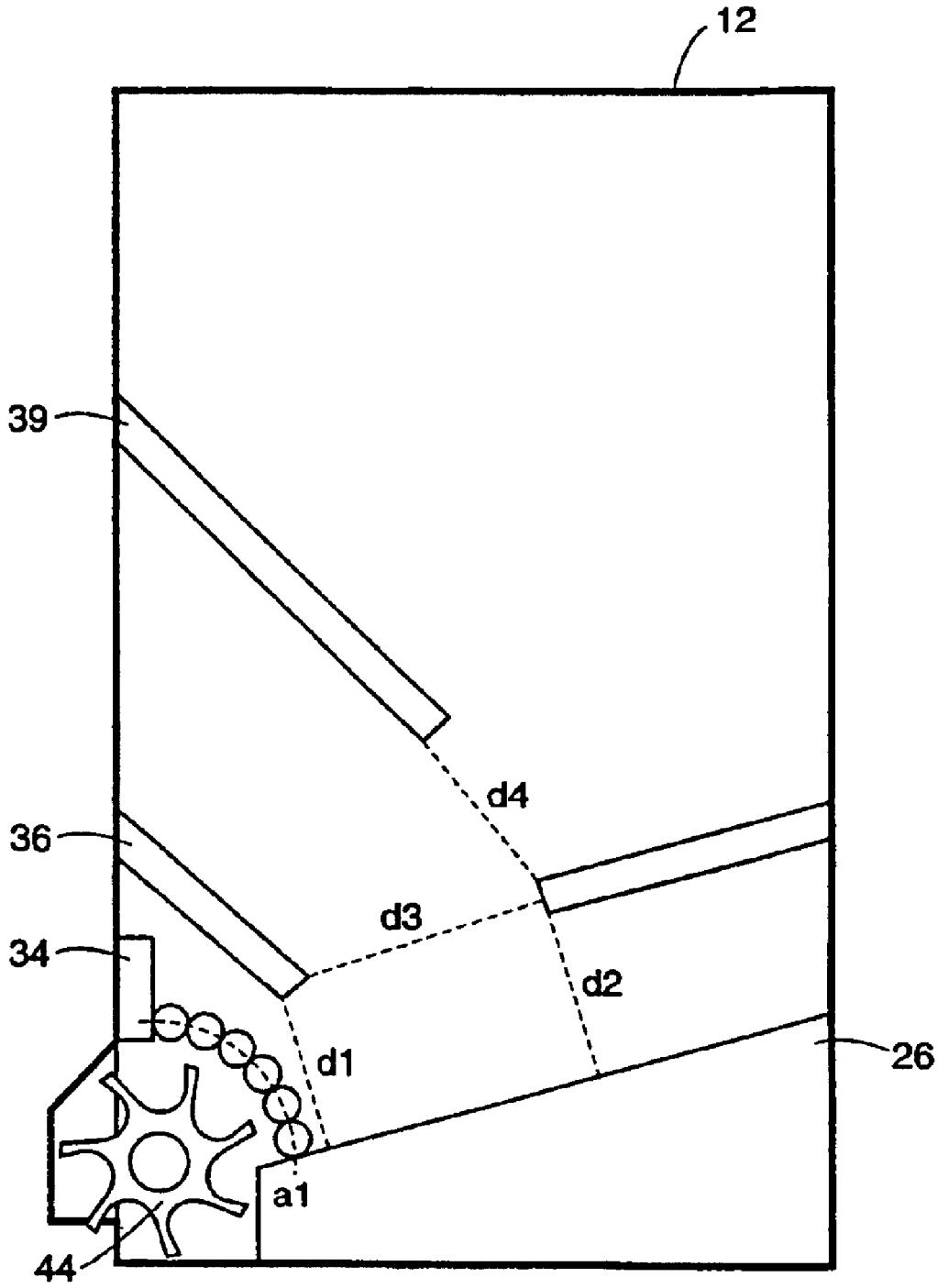
FIG. 5 is a schematic view of the toothed wheel and receptacle, with certain paths between points indicated.

Upon selecting the size and shape of the wheel 44 and back plate 24 for a given coin roll 18, it is then necessary to select the appropriate guide means. The factors involved in this consideration are shown in FIG. 5. In the preferred embodiment, the guide means consists of one or more guide ramps. As shown in FIG. 5, the guide means would include at least the first ramp 36, and possibly the second ramp 38, and possibly a third ramp 39.

As noted the present invention makes use of a vertically stacked array of coin rolls 18 that move under the Influence of gravity towards a dispensing means. Since there are many coin rolls packed closely together, there is a risk that a group of coin rolls will jam together and form a blockage. If this occurs, it would prevent the coin rolls that form the jam, and all coin rolls above the jam, from proceeding down to the dispensing means. In that case the coin roll dispenser would be unable to dispense all of the stored coin rolls, and a service call would be necessary to remove the blockage.

There are primarily two factors that contribute to the creation of a jam or blockage in the receptacle of the present invention. One factor is the accumulated weight of the vertical stacked array of coin rolls. The accumulated weight is greatest at the bottom of the stack, in particular in or about the lower ramp 26 and the toothed wheel 44. The effect of the accumulated weight is that it can overcome the otherwise natural tendency of the coin rolls to roll or move towards the dispensing means under the influence of gravity. As a result, the coin rolls affected may remain in place rather than roll towards the toothed wheel. The accumulated weight on the toothed wheel 44 can overcome the force of the motor drive, and thereby prevent it from turning. Yet another effect is that the force of accumulated weight can cause the wrapper material to tear.

For these reasons, it is preferred that the first ramp 36 be installed above the toothed wheel 44, to remove some of the accumulated weight from the toothed wheel, and ensure that the toothed wheel is capable of being driven by the electric motor 40. While the first ramp 36 should relieve accumulated weight over the toothed wheel, there may still be a problem of accumulated weight hindering or blocking movement of coin rolls on the lower ramp 28. If this occurs, it is preferred to provide the second ramp 38. Again, a problem of accumulated weight may persist, perhaps with respect to coin rolls above the first ramp 36, in which case a third ramp 39 would be recommended.

By way of example, it was determined that a single first ramp 36 was sufficient for most of the coins used with the preferred embodiment. An exception was the casino token, which is particularly heavy. Accordingly, for that coin the second ramp 38 was provided. Another exception was the dime coin roll, which by contrast is relatively light. However, the dime has an especially small diameter. Therefore while the dime coin roll is relatively light, the capacity of the receptacle 12 to hold dime coin rolls is very large, so the accumulated weight of the dime coin rolls is correspondingly high. As a result, it was found that the receptacle for the dime coin roll required both a second ramp 38 and a third ramp 39.

The second key factor that contributes to the creation of a jam or blockage is that contiguous coin rolls may tightly jam and form a "bridge" between two stationary points inside the receptacle. For example, FIG. 5 shows a bridge that could be formed by contiguous coin rolls across arc *a*1 between the far left surface of lower ramp 26 and the jam plate 34. This bridge would prevent any coin rolls from reaching the toothed wheel, rendering the coin roll dispenser inoperable. FIG. 5 also shows a variety of paths designated as *d*1, *d*2, *d*3, and *d*4 in which bridges might be more likely to be formed, as they represent the shortest paths between stationary points for the configuration shown.

It has been found that, as a general guideline in designing the receptacle of the present invention, the tendency for the coin rolls to form bridges is reduced if the minimum distance between any two stationary points is greater than seven times the diameter of the coin roll being stored in the receptacle. The reason is that there is a very low probability that seven coin rolls will align, and stay aligned, with the precision necessary to form a bridge. In all likelihood, at least one of the seven will move out of place and prevent the bridge from being formed. In FIG. 5 arc *a*1 is shown as being six coin rolls in place. Since this is less than seven coin roll diameters, the risk of a bridge or jam forming would be higher than desired. Similarly, it would be desirable to design each of the paths *d*1, *d*2, *d*3, and *d*4 so that they are greater than seven coin roll diameters. This can be achieved by shortening the lengths of one or more of the ramps 36, 38, and 39.

The angle made by the ramp with the horizontal is another design consideration. There is a tradeoff in this factor in that the more horizontal the ramp, the more coin rolls can be supported, and there is a greater relief of accumulated weight from the lower sections. While this is desirable, there is also an undesirable effect in that the closer the ramp is to the horizontal, there is an increased likelihood that one or more coin rolls on the ramp will remain on the ramp and fail to roll down under the influence of gravity. Therefore it is preferred that the ramps have a sharp enough angle to ensure that any coin rolls on their surface will roll down.

All of the above factors regarding support of accumulated weight, proximity of stationary surfaces, and ramp angle are to be considered in determining the appropriate guide means for a given coin roll. As discussed above, the guide means and guide ramps of the present invention function both as a guide, to help direct movement of the coin rolls, and as a support, to offload some of the accumulated weight of the coin rolls.

In cases such as shown in FIG. 5 where the distance along arc *a*1 would tend to be less than seven coin roll diameters, the risk of a bridge forming may be reduced by substituting a toothed wheel 44 of larger diameter. Using an appropriately sized toothed wheel, this would have the effect of increasing the length of arc *a*1 to greater than seven coin roll diameters. However a largerwheel may necessitate use of a differently sized and shaped receptacle. For convenience in manufacturing and servicing, it may be therefore be impractical to use a larger toothed wheel.

Figure 6:
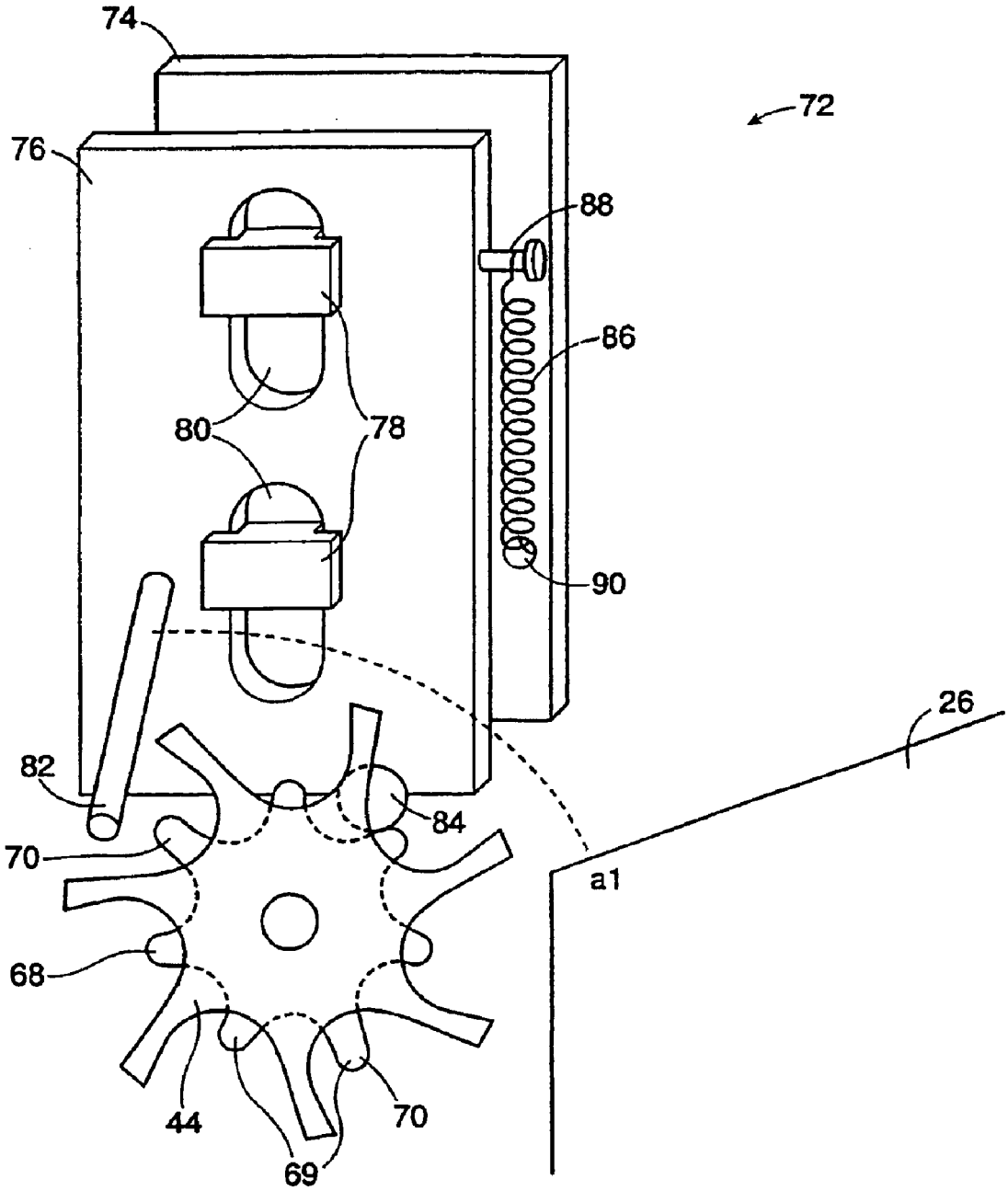
FIG. 6 is a perspective view of a cam wheel and kicker plate.

The present invention contemplates an additional mechanism that may be added to the receptacle 12 to reduce the risk of a bridge forming along arc *a*1. The additional mechanism is a kicker plate 72, shown in FIG. 6. Also shown in FIG. 6 is lower ramp 26 and toothed wheel 44. This toothed wheel has seven slots and, as shown earlier in FIG. 3(*c*), is the configuration used with casino tokens. Also as shown earlier in FIG. 3(*d*), this toothed wheel has an attached cam wheel 68. This is a smaller toothed wheel, also with seven teeth 69. The cam wheel 68 also has two teeth 70 that are slightly longer than the other five teeth.

The kicker plate 72 has a fixed plate 74 which attaches to the receptacle 12, and a movable plate 76 that attaches to the fixed plate 74 through bushings 78 that project through holes 80 in the removable plate. There is a rod 82 that projects away from and preferably perpendicular to the movable plate 76. There is also a cam-engaging knob 84 that attaches to and projects below the movable plate 76. There is also a spring 86 that connects an upper point 88 on the movable plate 76 to a lower point 90 on the fixed plate 74.

The rod 82 is positioned to intercept the path of arc *a*1. As noted, arc *a*1 defines a path across which there is a higher probability of a bridge being formed, as it is less than seven coin roll diameters. The function of the kicker plate 72 is that it moves the rod 82 vertically with each rotation of the toothed wheel 44, thereby creating a moving surface at one end of arc *a*1, so that a bridge cannot form.

In operation, the kicker plate operates as follows. When the toothed wheel 44 rotates to dispense a coin roll, the cam wheel 68 also turns. The cam wheel tooth 69 pushes the cam-engaging knob 84, thereby raising movable plate 76, which slides along bushings 80. This raises rod 82. As the cam-engaging knob passes over the top of cam wheel tooth 69, the movable plate 76 is no longer being pushed up, and spring 86 retracts the movable plate 76 to the initial position, which lowers rod 82. As a result, every time a coin roll is dispensed, rod 82 cuts across arc *a*1 and breaks up any bridge of coin rolls that may be in the process of formation.

The long cam wheel teeth 70 serve the purpose of pushing movable plate 76 marginally higher, and also by stretching spring 86 further, cause rod 82 to retract with marginally greater force. Since there are two long cam wheel teeth 70, this has the effect that on two out of every seven coin rolls dispensed there is a stronger force applied to break up any potential bridge.

With respect to the group of coins used with the preferred embodiment of the invention, it was found that the casino token and Canadian 2 dollar coin, both of which have relatively large diameters, required the addition of the kicker plate 72 to better protect against the creation of jam. Again, as noted above, a larger toothed wheel 44 could be used instead of the kicker plate 72 where desired. It can also be appreciated that other means of implementing the kicker plate 72 may be employed, as long as the function of moving a surface to prevent the formation of a bridge of coin rolls is fulfilled.

Figure 7:
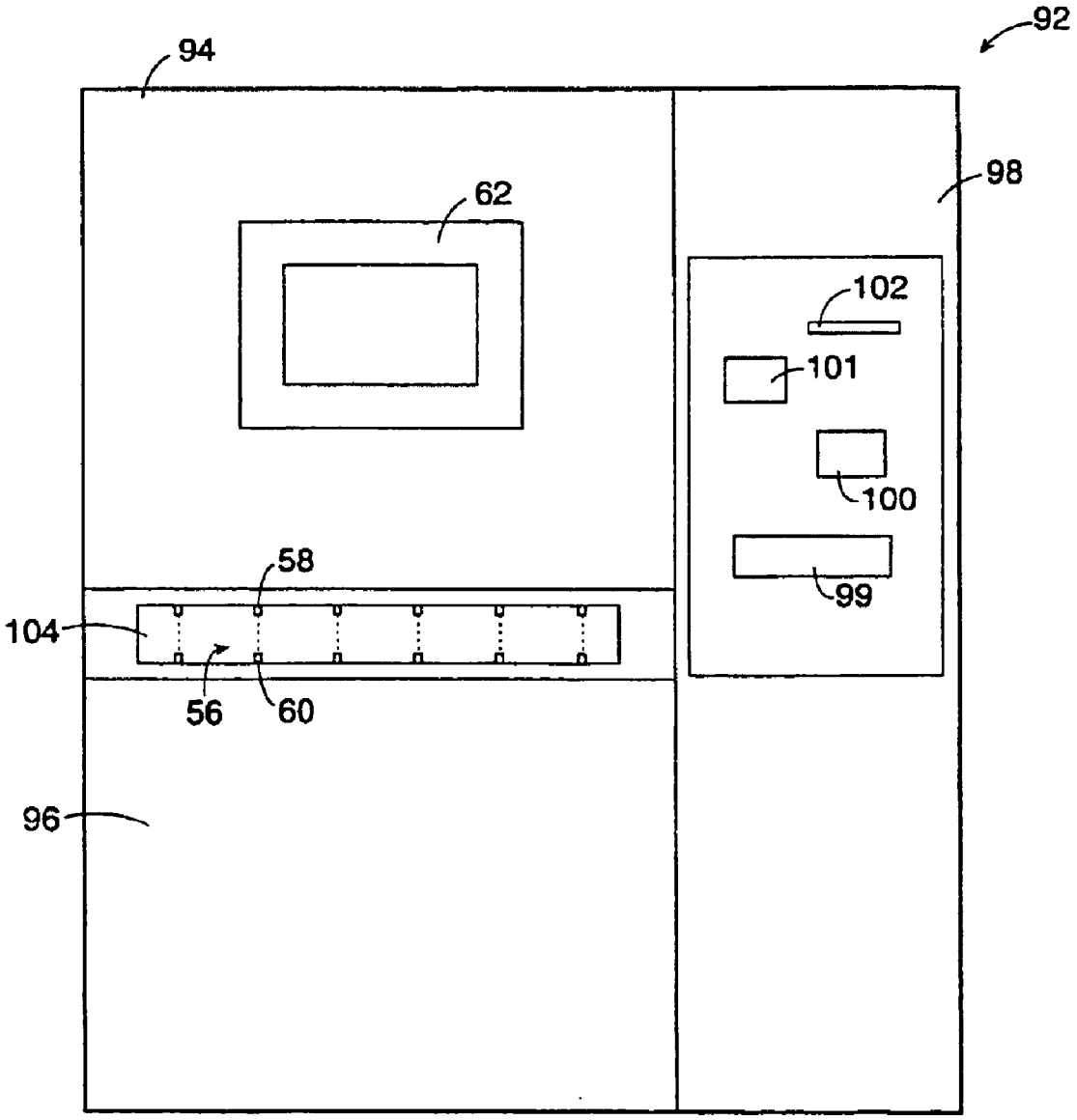
FIG. 7 is a front view of the change making machine of the present invention.

FIG. 7 shows that the apparatus of the present invention may be used to create a change making machine 92. For security reasons the change making machine 92 is preferably constructed from very strong material of the kind used to make a vault, such as thick carbon steel. The change making machine has a coin section 94, which holds an array of apparatuses 10 of the present invention. Typically, six or eight receptacles and associated dispensing means 14 are used, along with a single shared processor 62 and electrical interface 64. Where eight receptacles are used, then it is convenient to use two receptacles for each of the common coin denominations, i.e. pennies, nickels, dimes, and quarters. In the change making machine 92 shown in FIG. 7 there are six receptacles.

There is a storage section 96 positioned below the coin section 94, for use in storing coin rolls with which to replenish the change making machine 92. There is also a user interface section 98, which holds a cash dispenser 99, bill reader 100, magnetic card reader 101, and receipt printer 102. The user interface of the change making machine also includes the processor 62, which is located in the coin section 94. The processor 62 is most conveniently a touch-screen computer, so that the user can convey instructions by responding to prompts and touching the screen. It can be appreciated that other configurations of the change making machine are possible. For example, the storage section 96 may be removed, and some of the user input devices indicated may be removed, and others substituted.

In the preferred embodiment shown, the coin rolls that are dispensed fall into a coin slot 104 that extends across the width of the coin section 94. Arrayed across coin slot 104 are the dispense detectors 56 for each of the six receptacles contained in this particular machine. As shown before in FIG. 1, each dispense detector has a light emitting diode 58 and a photo sensor 60. Whenever a coin roll is dispensed from a receptacle, the coin roll breaks the otherwise continuous path of light that exists between the l.e.d. 58 and photo sensor 60. This creates a signal that informs the electrical interface 64 that a coin roll has been dispensed from that particular receptacle.

Since the apparatuses of the change making machine each contain their own dedicated dispensing means 14, and since since there is a common processor 62, software control program, and electrical interface 64, the change making machine 92 can dispense coin rolls from different receptacles simultaneously. So for example, where the user requests 10 rolls each of nickels, dimes, and quarters, the change making machine can dispense 1 roll each of nickels, dimes, and quarters simultaneously. The rate at which a coin roll can be dispensed from any one apparatus is approximately 1 coin roll per second. Therefore, the change making machine 92 could dispense 1 roll each of nickels, dimes, and quarters per second, or a combined rate of 3 rolls per second. The entire request for the above-specified 30 rolls could be fulfilled in approximately 10 seconds. It can be appreciated that the speed at which coin rolls can be dispensed represents a significant advantage of the present invention.

Figure 8:
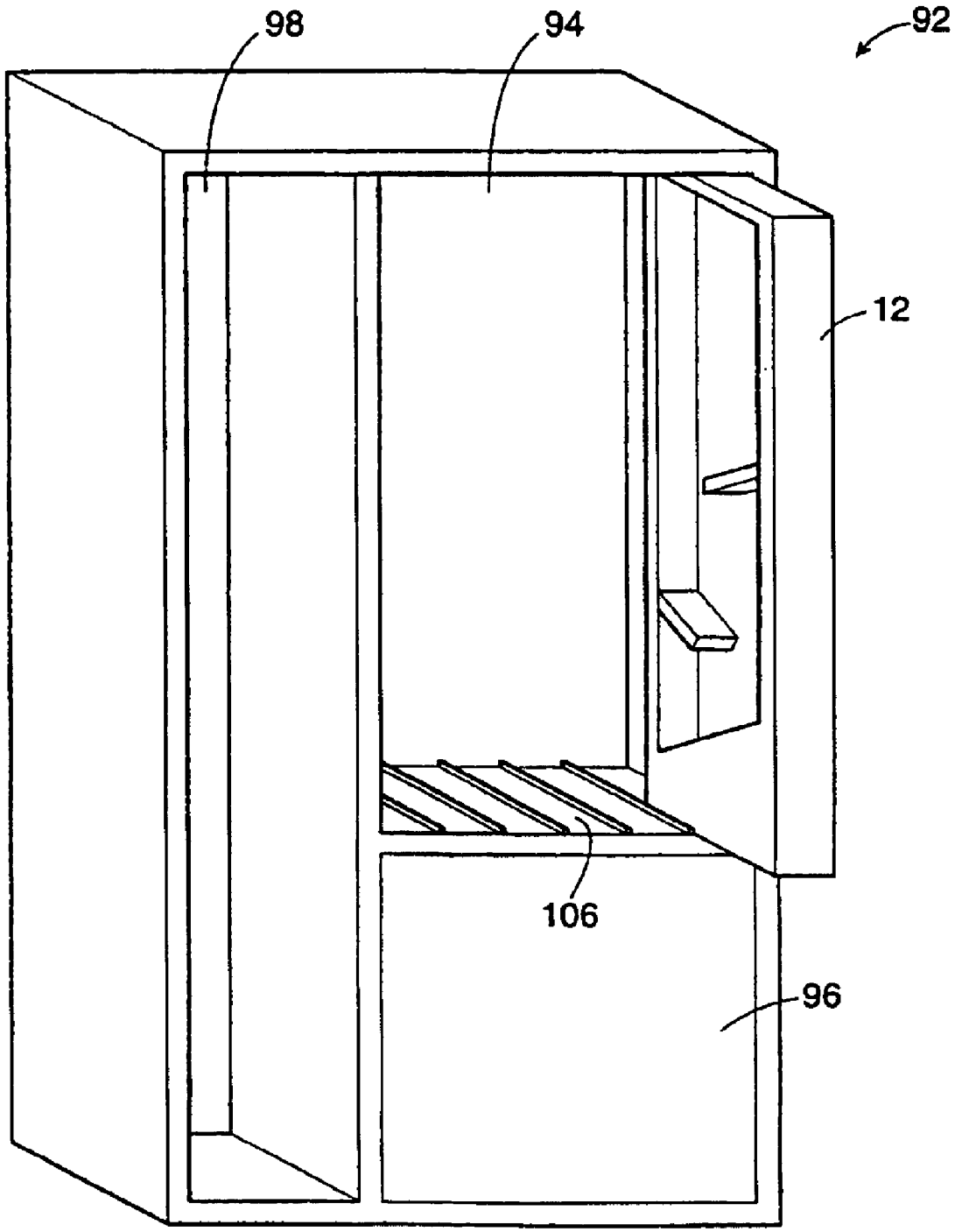
FIG. 8 is a perspective view taken from the back of the change making machine of the present invention.
Figure 9:
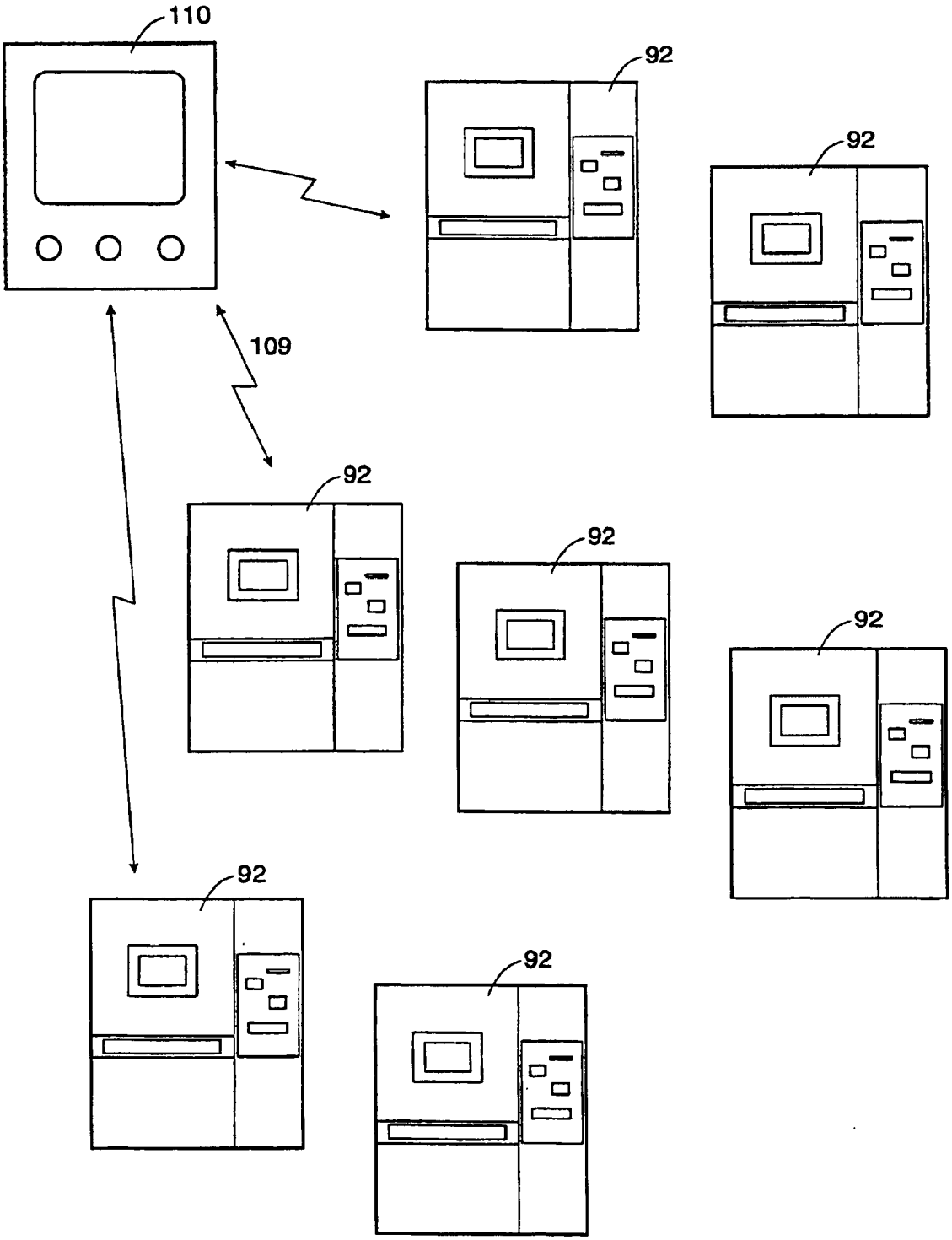
FIG. 9 is a schematic view of the coin roll dispensing system according to the present invention.

FIG. 8 shows a view from the back of the change making machine 92, with the machine being empty. This figure shows six receptacle slots 106 to accommodate six receptacles. In FIG. 8, for illustration purposes, a single receptacle 12 is shown partially inserted in one of the slots 106. When fully loaded, all six slots 106 will contain a receptacle 12.

In operation, the user interacts with the software control program on the visual display screen of processor 62. The user may insert paper currency into bill reader 100, or a magnetic card in magnetic card reader 101. The coin rolls selected will be retrieved from coin slot 104, and paper currency may be received from cash dispenser 99. Finally, a receipt 102 may be printed and received from receipt printer 102. The software control program that manages the user interface would include a validation procedure to validate whatever items the user deposits to receive authority to remove coins and cash. For example, a magnetic card or paper currency would need to be validated. Another type of item that may be deposited, not shown, would be an optically encoded card.

Also not shown in FIG. 7 is that the change making machine 92 could include a communication interface for communicating cash reserve and machine status information to an external controller. For example, the communication interface could be a connection to a dedicated data communications line, or an Internet connection, along with the software and hardware necessary to maintain such communication.

The change making machine described above gives rise to a broader invention of a coin roll dispensing system 108. This system would comprise one or more change making machines 92, a communication means, shown schematically by arrowheads 109, by which each change making machine could communicate coin reserve and machine status information to a designated remote location, and a central system controller 110, positioned at the remote location. The change making machines 92 could be all at one location, or they could be dispersed over many locations. For example, a bank could set up multiple cash and coin dispense centers, each of which contains several change making machines, and manage the entire operation from a single central location.

Through the information exchanged between the processor 62 of each change making machine 92 and the central system controller 110, the central system controller would have a comprehensive view of the cash and coin reserves of all the machines, as well as information regarding a malfunction of any machine in the system. The central system controller could use this information to efficiently maintain the system by dispatching service personnel where it is most appropriate to replenish machines with low reserves or to effect repairs. The central system controller could communicate over the communication means to individual machines, for example, to instruct a machine to shut down or to display a certain message. The central system controller could also communicate using other means, for example, by sending a fax to a service truck with updated instructions.

It is therefore an advantage of the present invention that an automated coin dispense machine or automated coin dispense system may be created that enables a provider of bulk coins such as a bank to dispense bulk coins without a live attendant and with a minimum of service personnel, and with increased control and efficiency.

It will also be understood that the present invention may be combined with other equipment or devices to make a more versatile cash dispensing device. Thus, while the foregoing description has concentrated on coin dispensing, the present invention also comprehends combining coin dispensing with a paper currency or paper cash dispenser as well. Such paper cash dispensers could extend the functionality of the devices to permit it to dispense both coins, or paper currency, or both if desired. Most preferably, the device would permit a customer to specify what ratio of each denomination, either coin, paper currency or both to dispense. Thus, the combined paper currency and a coin dispensing device of the present invention could be thought of as a form of instant banking machine with a coin dispensing feature.

It will be appreciated by those skilled in the art that the foregoing description was in respect of preferred embodiments and that various alterations and modifications are possible within the broad scope of the appended claims without departing from the spirit of the invention. For example, while reference is made to a dispensing means consisting of an electric motor driving a toothed wheel, other forms of dispensing means will also yield reasonable results. Also, while reference was made to the guide means being one or more ramps, other types of guide means may also be used. Various other modifications will be apparent to those skilled in the art but are not described in any further detail herein.

What is claimed is:

1. An apparatus for use in dispensing coin rolls, said apparatus comprising:

(a) a receptacle, to hold the coin rolls in a vertically stacked array;

(b) a dispensing means, to dispense the coin rolls from a bottom of the receptacle;

(c) a controller, to control the dispensing means responsive to instructions from a user, said controller comprising a computer operating a software control program, and a visual display screen for viewing by the user; and (d) a rotating device to prevent bridging;

wherein, upon receiving instructions from a user to dispense coin rolls, said controller controls said dispensing means so that said coin rolls are dispensed from the receptacle.

2. The apparatus according to claim 1, wherein the receptacle is configured to permit gravity to urge the coin rolls towards the dispensing means.

3. The apparatus according to claim 2, wherein the receptacle includes a guide means to help guide the movement of the vertically stacked array of coin rolls, under the influence of gravity, towards the dispensing means.

4. The apparatus according to claim 1, further including a front wall hinged to be openable, to facilitate replacement of coin rolls.

5. The apparatus according to claim 4, wherein the receptacle is sized and shaped so that the distance between the front wall and the back wall, or between the front wall and a removable plate that is attachable to the back wall of the receptacle, closely accommodates the length of the coin roll to be dispensed by the apparatus.

6. The apparatus according to claim 1, wherein the dispensing means is a toothed wheel rotated by a motor.

7. The apparatus according to claim 6, wherein said motor is a reversible electric motor.

8. The apparatus according to claim 6, wherein a slot is defined by adjacent teeth in the toothed wheel, each slot being sized and shaped to hold one coin roll.

9. The apparatus according to claim 6, wherein the teeth of the toothed wheel are configured to capture a coin roll urged towards said toothed wheel by gravity.

10. The apparatus according to claim 1, further including a dispense detector to inform the controller when a coin roll has been dispensed from the receptacle.

11. The apparatus according to claim 10, wherein the controller stops said dispensing means when said controller is informed by the dispense detector that at least one coin roll has been dispensed.

12. The apparatus according to claim 11, wherein the instructions provided by the user are to dispense coin rolls totalling a particular value, or to dispense one or more coin rolls of different denominations, and wherein the controller, through information provided by the dispense detector, keeps a count of the total value of the coin rolls being dispensed or the number of coin rolls of different denominations being dispensed.

13. The apparatus according to claim 12, wherein the controller stops said dispensing means when the total value of the coin rolls dispensed, or the number of coin rolls of different denominations dispensed, reaches the value or number specified in the instructions by the user.

14. The apparatus according to claim 1, further including a jam detector to inform the controller whether the dispensing means is jammed or otherwise not operating.

15. The apparatus according to claim 14, wherein, upon the controller receiving information from the jam detector that the dispensing means is not operating, and wherein the controller has received instructions from the user to dispense coin rolls, and said coin rolls have not been dispensed, said controller controls the dispensing means so that said dispensing means performs a re-activation procedure.

16. The apparatus according to claim 15, wherein said dispensing means has a forward mode in which said dispensing means dispenses coin rolls, and a reverse mode, and said re-activation procedure consists of operating the dispensing means in reverse mode for a predetermined period, and then attempting to operate the dispensing means in forward mode, and then repeating said re-activation procedure for a predetermined maximum number of times, or until the jam detector indicates that the dispensing means is operating in forward mode.

17. The apparatus according to claim 16, wherein the dispensing means includes a reversible electric motor, and wherein said forward mode comprises said reversible electric motor operating in a forward direction, and wherein said reverse mode comprises said reversible electric motor operating in a reverse direction.

18. The apparatus according to claim 1, wherein the visual display screen is a touchscreen.

19. An apparatus for use in dispensing coin rolls, said apparatus comprising:

(a) a receptacle, to hold the coin rolls in a vertically stacked array;

(b) a dispensing means, to dispense the coin rolls from a bottom of the receptacle;

(c) a controller, to control the dispensing means responsive to instructions from a user;

(d) a rotating device to prevent bridging; and (e) a dispense detector to inform the controller when a coin roll has been dispensed from the receptacle;

wherein, upon receiving instructions from a user to dispense coin rolls, said controller controls said dispensing means so that said coin rolls are dispensed from the receptacle;

and wherein the controller stops said dispensing means when said controller is informed by the dispense detector that at least one coin roll has been dispensed;

and wherein the instructions provided by the user are to dispense coin rolls totaling a particular value, or to dispense one or more coin rolls of different denominations, and wherein the controller, through information provided by the dispense detector, keeps a count of the total value of the coin rolls being dispensed or the number of coin rolls of different denominations being dispensed.

20. The apparatus according to claim 19, wherein the controller stops said dispensing means when the total value of the coin rolls dispensed, or the number of coin rolls of different denominations dispensed, reaches the value or number specified in the instructions by the user.

21. An apparatus for use in dispensing coin rolls, said apparatus comprising:

(a) a receptacle, to hold the coin rolls in a vertically array;

(b) a dispensing means, to dispense the coin rolls from a bottom of the receptacle;

(c) a controller, to control the dispensing means responsive to instructions from a user, (d) a rotating device to prevent bridging; and (e) a jam detector to inform the controller whether the dispensing means is jammed or otherwise not operating;

wherein, upon receiving instructions from a user to dispense coin rolls, said controller controls said dispensing means so that said coin rolls are dispensed from the receptacle;

and wherein, upon the controller receiving information from the jam detector that the dispensing means is not operating, and wherein the controller has received instructions from the user to dispense coin rolls, and said coin rolls have not been dispensed, said controller controls the dispensing means so that said dispensing means performs a re-activation procedure.

22. The apparatus according to claim 21, wherein said dispensing means has a forward mode in which said dispensing means dispenses coin rolls, and a reverse mode, and said re-activation procedure consists of operating the dispensing means in reverse mode for a predetermined period, and then attempting to operate the dispensing means in forward mode, and then repeating said re-activation procedure for a predetermined maximum number of times, or until the jam detector indicates that the dispensing means is operating in forward mode.

23. The apparatus according to claim 22, wherein the dispensing means includes a reversible electric motor, and wherein said forward mode comprises said reversible electric motor operating in a forward direction, and wherein said reverse mode comprises said reversible electric motor operating in a reverse direction.

* * * * *